US011112090B1

(12) United States Patent
Chang

(10) Patent No.: US 11,112,090 B1
(45) Date of Patent: Sep. 7, 2021

(54) HEAD-MOUNTED LED LIGHT WITH INTEGRATED, ADJUSTABLE IRIS

(71) Applicant: General Scientific Corp., Ann Arbor, MI (US)

(72) Inventor: Byung Jin Chang, Ann Arbor, MI (US)

(73) Assignee: General Scientific Corp./Surgitel, Ann Arbor, MI (US)

( * ) Notice: Subject to any disclaimer, the term of this patent is extended or adjusted under 35 U.S.C. 154(b) by 0 days.

(21) Appl. No.: 16/988,378

(22) Filed: Aug. 7, 2020

(51) Int. Cl.

| | |
|---|---|
| ***F21V 14/06*** | (2006.01) |
| ***F21K 9/69*** | (2016.01) |
| ***F21L 14/02*** | (2006.01) |
| ***A42B 1/244*** | (2021.01) |
| ***F21V 33/00*** | (2006.01) |
| ***F21V 14/08*** | (2006.01) |
| ***F21K 9/65*** | (2016.01) |
| ***F21W 131/202*** | (2006.01) |
| ***F21Y 115/10*** | (2016.01) |

(52) U.S. Cl.
CPC ..... *F21V 14/065* (2013.01); *A42B 1/244* (2013.01); *F21K 9/65* (2016.08); *F21K 9/69* (2016.08); *F21L 14/02* (2013.01); *F21V 14/08* (2013.01); *F21V 14/085* (2013.01); *F21V 33/0008* (2013.01); *F21W 2131/202* (2013.01); *F21Y 2115/10* (2016.08)

(58) Field of Classification Search
CPC .... F21V 14/065; F21V 33/008; F21V 14/085; F21V 14/08; F21K 9/69; F21K 9/65; A42B 1/244; F21L 14/02; F21Y 2115/10; F21W 2131/202
USPC ..... 362/105, 106, 280, 281, 282, 283, 284
See application file for complete search history.

(56) References Cited

U.S. PATENT DOCUMENTS

| | | | | | |
|---|---|---|---|---|---|
| 4,104,709 | A * | 8/1978 | Kloots | F21L 14/00 | 362/105 |
| 4,516,190 | A * | 5/1985 | Kloots | F21L 14/00 | 362/106 |
| 4,621,283 | A * | 11/1986 | Feinbloom | F21L 15/14 | 348/77 |
| 5,163,420 | A * | 11/1992 | Van Der Bel | F21L 14/00 | 362/105 |
| 5,709,459 | A * | 1/1998 | Gourgouliatos | F21L 14/00 | 362/105 |

(Continued)

*Primary Examiner* — Laura K Tso
(74) *Attorney, Agent, or Firm* — The Law Offices of John G. Posa

(57) ABSTRACT

A head-mountable light includes a user-adjustable spot size. Light from an LED travels through beam-forming optical elements supported at the front opening of a housing to form a spot of light at a working distance. An adjustable iris, situated between the LED and the beam forming optical elements, enables a user to adjust the iris and vary the size of the aperture and the spot size of the light at the working distance. The manually operated iris size control may comprise a rotatable ring on the exterior of the housing, and the plurality of beam-forming optical elements may comprise a singlet lens followed by a doublet lens. The light from the LED strikes the beam-dispersing element directly without an intervening condensing optical element (i.e., condensing lens). The assembly further includes a mechanical connector adapted to couple the housing to a pair of eyeglass frames, headband or other head-worn structure.

10 Claims, 2 Drawing Sheets

(56) References Cited

U.S. PATENT DOCUMENTS

| | | | | |
|---|---|---|---|---|
| 5,769,523 | A * | 6/1998 | Feinbloom | F21V 14/085 362/554 |
| 5,774,271 | A * | 6/1998 | Lagerway | F21L 14/00 359/649 |
| 5,893,635 | A * | 4/1999 | Bhattacharya | F21L 15/02 362/105 |
| 7,314,300 | B1 * | 1/2008 | Dorr | A61B 90/35 362/581 |
| 7,618,159 | B2 * | 11/2009 | Tamburrino | F21V 11/10 362/321 |
| 10,690,325 | B2 * | 6/2020 | Ferguson | A61B 1/00096 |
| 2012/0120635 | A1 * | 5/2012 | Strong | F21V 5/008 362/105 |
| 2012/0320454 | A1 * | 12/2012 | Chang | F21V 21/084 359/385 |

* cited by examiner

HEAD-MOUNTED LED LIGHT WITH INTEGRATED, ADJUSTABLE IRIS

FIELD OF THE INVENTION

This invention relates generally to head-mounted lights and, in particular, to a head-mounted LED light with an integrated iris to adjust light spot size at a working distance.

BACKGROUND OF THE INVENTION

Head-mounted lights are commonly used by medical and dental professionals to improve visualization in conjunction with various patient procedures. Such lights have improved dramatically over the years, replacing incandescent halogen or xenon lights sources with brighter, more efficient light-emitting diodes (LEDs).

However, there are certain procedures wherein it would be advantageous to adjust spot size while maintaining brightness, uniformity and other beam characteristics. For example, several ENT (ear, nose, and throat) procedures require smaller beams to effectively see inside patient cavities and orifices.

SUMMARY OF THE INVENTION

This invention improves upon the existing art by providing a head-mountable light with an adjustable spot size. The apparatus includes a housing with a front opening, a rear portion, and an interior. A power cord extends through the rear portion of the housing and connects to a light-emitting diode (LED) positioned within the interior of the housing. Light from the LED travels through a plurality of beam-forming optical elements coupled to the front opening of the housing to form a spot of light from the LED having a spot size at a working distance from the headlamp. An adjustable iris is situated between the LED and the beam forming optical elements. A manually operated control, accessible on the exterior of the housing, enables a user to adjust the iris and vary the size of the aperture and the spot size of the light at the working distance.

In the preferred embodiment, the manually operated control comprises a rotatable ring on the exterior of the housing, and the plurality of beam-forming optical elements includes a beam-dispersing element and a beam-focusing element. The beam-dispersing element may be a singlet lens, and the beam-focusing element may comprise a doublet lens. The light from the LED strikes the beam-dispersing element directly without an intervening condensing optical element (i.e., condensing lens).

The housing may comprise a two-part housing assembly, including a separate housing component containing the adjustable iris, or a three-part housing assembly, including a first separate housing component containing the adjustable iris and a second separate housing component that contains the plurality of beam-forming optical elements.

The adjustable may be controlled to vary the spot size from 0.5 to 10 cm at a working distance in the range of 12 to 24 inches. The LED is a warm white, neutral white, cool white LED, or a combination thereof. The head-mountable light preferably further includes a mechanical connector adapted to couple the housing to a pair of eyeglass frames, headband or other head-mounting structure.

DETAILED DESCRIPTION OF THE PREFERRED EMBODIMENTS

Figure 1:
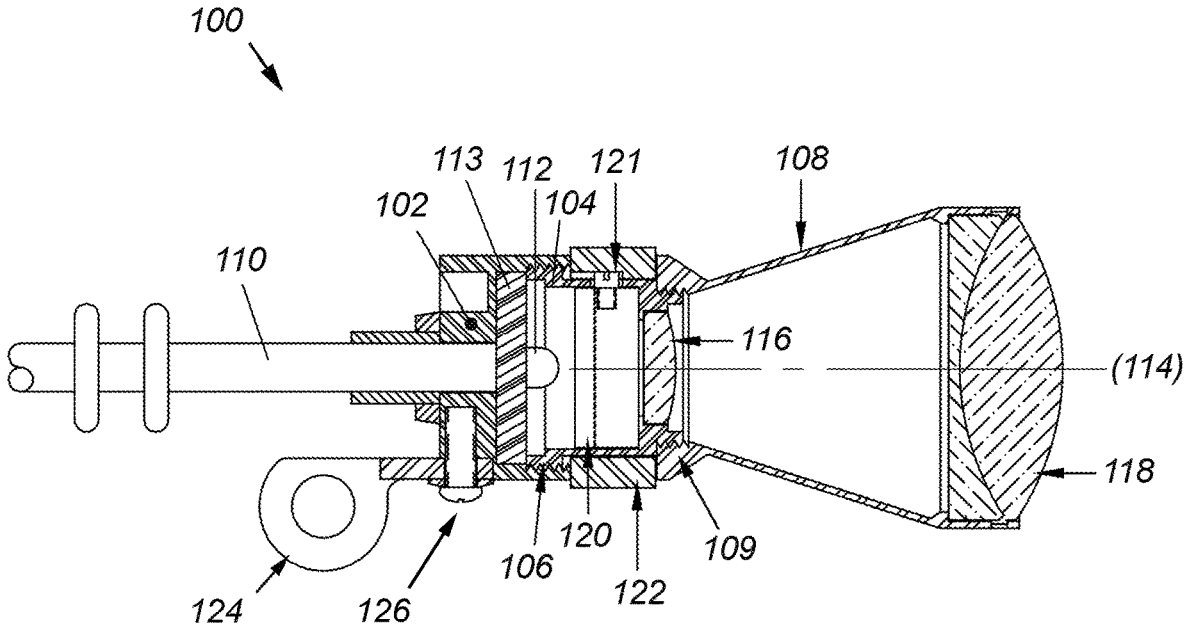
FIG. 1 is drawing in partial cross section depicting a preferred embodiment of the invention.

FIG. 1 is drawing in partial cross section depicting a preferred embodiment of the invention, depicted generally at 100. The apparatus comprises a main housing 102. Main housing 102 is coupled to an aperture housing 104, preferably through the use of a threaded connection 106. Aperture housing 104 is in turn coupled to a lens fixture 108 via threaded connection 109. The main housing 102 and aperture housing 104 may assume partial cylindrical barrel shapes, and the lens fixture 108 may be conical, as shown. All of the housing components may be constructed of hard plastic or metals such as aluminum, steel, and so forth.

A power cable 110, penetrating a rear portion of main housing 104, makes electrical connection to light-emitting diode (LED) 112 mounted on printed circuit board (PCB) 113. The invention is not limited in terms of the LED source used, which may comprise a warm, neutral or cool white LED color temperatures: i.e., "warm" at about 3000-3700K; "neutral" in the range of 4000-4700K; and "cool" in the range of 5700-6500K. The output of LED 112 defines an optical axis 114. The light from LED 112 passes through beam-shaping optics to focus the light to a uniform spot over a range of working distances.

While different lenses or lens combinations may be used, in the preferred embodiment, light from LED 112 passes through a singlet diverging lens 116, followed by a larger diameter doublet focusing lens 118. A similar optical arrangement is disclosed and described in my U.S. Pat. No. 8,047,684, the entire content of which is incorporated herein by reference.

Unique to the invention, an adjustable iris 120 is supported within aperture housing 104. An outer ring disposed on the outer barrel of aperture housing 104 adjusts the size of the aperture and the spot of light produced by the LED when the ring is turned. While different working distances may be accommodated, at an exemplary working distance of 16 inches, the spot size may be adjustable from about 0.5 cm up to about 10 cm. As with lenses 116, 118, adjustable opening in the iris is positioned along optical axis 114.

Note that light from LED passes through adjustable iris 120 and strikes the rear surface of lens 116 directly, without any intervening optical elements. In particular, a condenser lens is not required between the LED and singlet lens 116 in this design.

Figure 2:
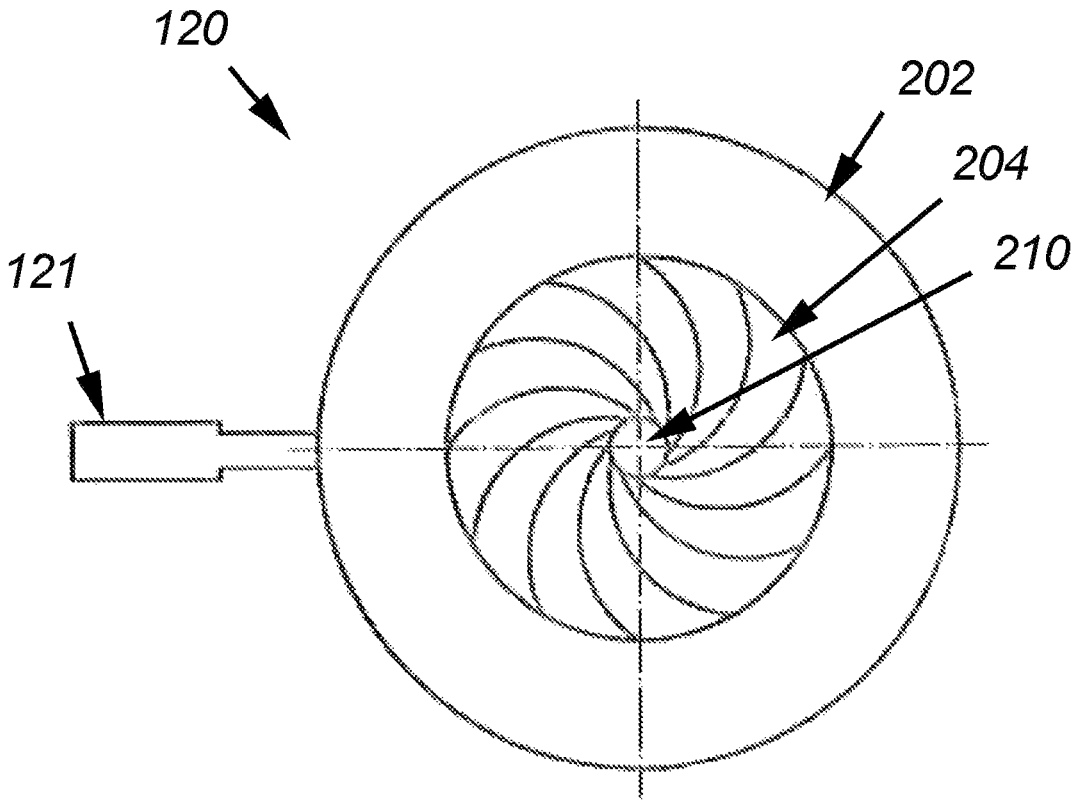
FIG. 2 is a drawing the shows an adjustable iris applicable to the invention.

FIG. 2 is a drawing the shows an adjustable iris 120 applicable to the invention. Common to conventional iris or diaphragm mechanisms, the assembly includes a plurality of leaves or blades 204. While straight blades may be used, this results in an undesirable polygonal shape of the diaphragm opening. As such, in the preferred embodiment, curved blades are used to improve the roundness of the iris opening. The blades are supported for pivotal movement within housing 202, which also contains an inner ring (not shown), which rotates as outer ring 122 is turned. Ring 122 is coupled to the inner ring through threaded fastener 121. Those of skill will appreciate that any existing adjustable iris or diaphragm may be alternatively be used so long as the opening on axis central point 210 is user variable.

The LED light with user-adjustable iris just described is coupled to a mechanism that facilitates head mounting, preferably with one or more degrees of freedom. For example, as shown, main housing 102 may be connected to mounting tab 124 through threaded fastener 126. Tab 124 may, in turn, be coupled to another structure that facilitates head mounting, including eyeglass frames or a headband, neither of which are shown but may be seen at www.surgitel.com or other websites.

The invention claimed is:

1. A head-mountable light with an adjustable spot size, comprising:

a housing having a front opening, a rear portion, and an interior;

a power cord having a first end connectable to a source of electrical power, and a second end that extends through the rear portion of the housing and into the interior of the housing;

a light-emitting diode (LED) positioned within the interior of the housing and connected to the power cord to emit light along an optical axis out the front opening of the housing;

a plurality of beam-forming optical elements coupled to the front opening of the housing on the optical axis, the beam-forming optical elements being operative to form a spot of light from the LED having a spot size at a working distance from the housing;

an adjustable iris disposed in the interior of the housing between the LED and the beam forming optical elements, the adjustable iris including a variable-sized aperture centered on the optical axis;

wherein light from the LED strikes the adjustable iris directly with no optical elements disposed between the LED and the adjustable iris; and a manually operated control accessible on the exterior of the housing enabling a user to adjust the iris and vary the size of the aperture and the spot size of the light at the working distance.

2. The head-mountable light of claim 1, wherein the manually operated control comprises a rotatable ring on the exterior of the housing.

3. The head-mountable light of claim 1, wherein the plurality of beam-forming optical elements includes a beam-dispersing element and a beam-focusing element, and wherein the beam-dispersing element is situated between the adjustable iris and the beam-focusing element.

4. The head-mountable light of claim 3, wherein the beam-dispersing element is a singlet lens.

5. The head-mountable light of claim 3, wherein the beam-focusing element is a doublet lens.

6. The head-mountable light of claim 1, wherein the housing is a two-part housing, including a separate housing component containing the adjustable iris.

7. The head-mountable light of claim 1, wherein the housing is a three-part housing, including a first separate housing component containing the adjustable iris and a second separate housing component that contains the plurality of beam-forming optical elements.

8. The head-mountable light of claim 1, wherein the adjustable iris is adjustable to vary the spot size from 0.5 to 10 cm at a working distance in the range of 12 to 24 inches.

9. The head-mountable light of claim 1, wherein the LED is a warm white, neutral white or cool white LED.

10. The head-mountable light of claim 1, further including a mechanical connector adapted to couple the housing to a pair of eyeglass frames, headband or other head-mounting structure.

* * * * *